US005746640A

United States Patent [19]

Meadows

[11] Patent Number: 5,746,640

[45] Date of Patent: May 5, 1998

[54] MOTION-ACTIVATED MUSICAL DEVICE

[76] Inventor: Michael R. Meadows, 2226 W. Barker, West Peoria, Ill. 61604

[21] Appl. No.: 642,589

[22] Filed: May 3, 1996

Related U.S. Application Data

[63] Continuation-in-part of Ser. No. 349,681, Dec. 5, 1994, abandoned.

[51] Int. Cl.[6] ..... A63H 5/00

[52] U.S. Cl. ..... 446/213; 446/215; 446/397; 84/330

[58] Field of Search ..... 446/188, 202, 446/203, 204, 213, 215, 216, 265, 397; 84/384, 380 R, 330

[56] References Cited

U.S. PATENT DOCUMENTS

| | | | |
|---|---|---|---|
| 140,206 | 6/1873 | Lee | 446/215 |
| 186,255 | 1/1877 | Jenkins . | |
| 291,548 | 1/1884 | Swan | 84/330 |
| 491,571 | 2/1893 | Long . | |
| 1,257,448 | 2/1918 | Belton | 446/215 |
| 1,498,280 | 6/1924 | Izold | 84/380 R |
| 1,655,529 | 1/1928 | Baver | 446/215 |
| 2,637,141 | 5/1953 | De Nisco | 446/216 |
| 2,968,890 | 1/1961 | De Nisco | 446/216 |
| 3,523,387 | 8/1970 | Smith | 446/213 |
| 3,722,348 | 3/1973 | Visser | 84/384 |
| 4,033,069 | 7/1977 | Arzola | 446/215 |
| 4,100,697 | 7/1978 | Ward | 446/265 |
| 4,116,108 | 9/1978 | Hyman | 446/213 |
| 4,167,831 | 9/1979 | Arzola | 446/215 |
| 4,203,252 | 5/1980 | Howie | 446/216 |
| 4,215,646 | 8/1980 | Williams . | |
| 4,252,076 | 2/1981 | Williams | 116/137 R |
| 4,380,134 | 4/1983 | Taluba et al. | 446/188 |
| 4,443,201 | 4/1984 | Diefenbach | 446/213 |
| 5,087,220 | 2/1992 | Cotita | 446/215 |
| 5,306,193 | 4/1994 | Yang | 446/215 |
| 5,309,806 | 5/1994 | Stavash | 84/380 R |

FOREIGN PATENT DOCUMENTS

| | | | |
|---|---|---|---|
| 337372 | 4/1904 | France | 446/215 |
| 580417 | 11/1924 | France | 446/213 |
| 387515 | 12/1923 | Germany | 446/215 |
| 405224663 | 9/1993 | Japan | 84/380 R |
| 96003 | 9/1922 | Switzerland | 446/215 |
| 132481 | 9/1819 | United Kingdom | 446/215 |

OTHER PUBLICATIONS

John Rayleigh, *The Theory of Sound vol. II* 1877 pp. 411–412.

Chanavd and Powell, "Some Experiments Concerning the Hole and Ring Tone" JASA vol. 37 No. 5 May 1964 pp. 902–910.

"Singing Corrugated Pipes," AJP vol. 43, Apr. 1974; by Frank Crawford.

*Primary Examiner*—Robert A. Hafer
*Assistant Examiner*—Jeffrey D. Carlson

[57] ABSTRACT

A motion-activated musical device is disclosed which sounds harmonic overtones of a longitudinal resonator. Swinging the device causes the formation of a pressure differential across the device. This pressure differential causes air to flow through the longitudinal resonator, initiating an oscillation in the hole tone resonator. A standing wave is then established in the longitudinal resonator in response to this oscillation and a musical tone results. Variations in motion cause the device to sound a sequence of harmonically related musical tones.

3 Claims, 4 Drawing Sheets

MOTION-ACTIVATED MUSICAL DEVICE

This is a CIP of Ser. No. 08/349,681 filed Dec. 5, 1994, now abandoned.

BACKGROUND

1. Field of Invention

The invention is in the field of musical instruments known as aerophones, specifically those which produce harmonic musical tones as a result of motion through air.

2. Discussion of Prior Art

In the past, those who were unskilled in the operation of conventional musical instruments had few options for participatory musical experiences. Nearly all operations for producing music demanded not only a fair amount of rhythmic sensitivity and manual dexterity, but also a familiarity with scales and chord progressions. A person lacking in any of these qualities may easily have become discouraged as a result.

A need exists, therefore, for an instrument which produces harmonious musical tones in response to simple movements by the performer. The pitch and duration of the tones should audibly reflect the qualities of these movements. The instrument should be sensitive to a large range of motion as well as to abrupt changes in movement.

One class of instruments that are easy to play is whirled instruments. These types of instruments have been around in various forms for hundreds of years, but the sounds produced by any single instrument have been extremely limited.

The bull-roarer is an example of a whirled instrument.

Others include:

U.S. Pat. Nos. 491,571 to Long (1893), No. 186,255 to Jenkins (1877), and No. 140,206 to Lee (1873) are basically whistling noisemakers which produce sound by being whirled through the air at the end of a string or cord. Long's and Jenkins' are both described as producing bird-like sounds but they lack any resonant structure to support the production of clearly defined musical tones. Lee's possesses a small resonant chamber that possibly renders the device capable of producing a single recognizable tone. The sound, however, would be noisy and intermittent as the device is whirled.

The aforementioned patents all utilize some type of hole tone whistle—a device such as that comprising the standard teakettle whistle. The use of the hole tone whistle has previously been limited to these and other noise-producing devices, and to acoustical experiments utilizing compressed air (e.g. Chanaud and Powell, JASA, April 1964).

In his *The Theory of Sound*, Volume 2 (1877), John Rayleigh describes his acoustical experiments using an open-sided type of hole tone whistle he refers to as a "bird call". He briefly describes an experiment in which a bird call was mounted at the end of a pipe 40–50 cm. long. In the experiment, a gentle stream of air introduced into the pipe caused various harmonics to sound. The experiment is described as an investigation into the manner in which air flows through the bird call, and there is no suggestion of the device being used as a motion-activated instrument. No remark is made on the significance of the harmonics produced, and the device is not referred to again in the text.

I constructed a device so as to fit the description of the one in Rayleigh's experiment and found it responded poorly when whirled. The few harmonic tones that sounded were weak and were further diminished by the sound of air turbulence. These qualities are thought to be due to the openings in the sides of the bird call which result from construction in the manner described by Rayleigh.

Prior art also includes two devices that do not use the hole tone whistle:

The "whirly-tone" is a flexible corrugated tube that generates harmonic pitches when whirled. Although this device has been used in musical performance, it must be whirled fairly quickly to sound. It moves among its 3–5 tones rather sluggishly, and its inherent flexibility makes it unwieldy and difficult to control.

Williams' U.S. Pat. Nos. 4,215,646 (1980) and No. 4,252,076 (1981) are for essentially similar devices (the latter one being tunable). It is described as a small tube with a single angular constriction that is mounted in a flow system. It sounds a tone when a restriction (such as a clogged filter) causes a pressure variation across the device. Its range is limited to one or two tones.

The prior art devices suffer from a number of disadvantages:

a. All must be whirled fairly quickly in order to sound properly; slow whirling motion produces either no sound or weak, indistinct tone.

b. All are quite limited in the number of sounds or tones they are capable of producing.

c. Whirling speed must vary substantially to produce variation in sound produced.

d. Whirling motion is difficult to control, and thus poses a potential hazard.

e. Melodic capabilities are minimal.

f. Rhythmic capabilities are nonexistent.

OBJECTS AND ADVANTAGES

Accordingly, several objects and advantages of the present invention are to provide a musical device which:

a. Produces distinct musical tones in response to minimal motion.

b. Produces many distinct musical tones over a wide range of swinging speeds.

c. Produces shift in musical tone with slight change in motion.

d. Is easily controlled.

e. Possesses melodic capabilities.

f. Possesses rhythmic capabilities g. Produces tones in discrete harmonically related intervals.

h. Is easy to play—no musical ability required of the player.

i. Audibly reflects a correlation between motion of device and tones produced.

j. Can be configured to produce two or more tones at a time.

k. Can be produced in any musical key or combination of keys.

l. Can be produced in a variety of sizes and shapes.

m. Is lightweight.

n. Is durable and reliable—no moving parts to wear out.

o. Is inexpensive to manufacture.

SUMMARY OF THE INVENTION

The invention provides a motion-activated musical device capable of generating discrete musical tones. The frequencies of these tones are determined by the harmonic modes of the device itself and by the speed and direction of its motion. The device comprises a longitudinal resonator and a hole tone resonator. The longitudinal resonator has an inner wall for receiving and transmitting airflow. The hole tone resonator is a chamber substantially enclosed by a chamber wall and by two restrictive structures both having an aperture for transmitting airflow. The dimensions and configuration of the hole tone resonator and longitudinal resonator are intended to be variable to suit the individual application.

DESCRIPTION OF INVENTION

Figure 1:
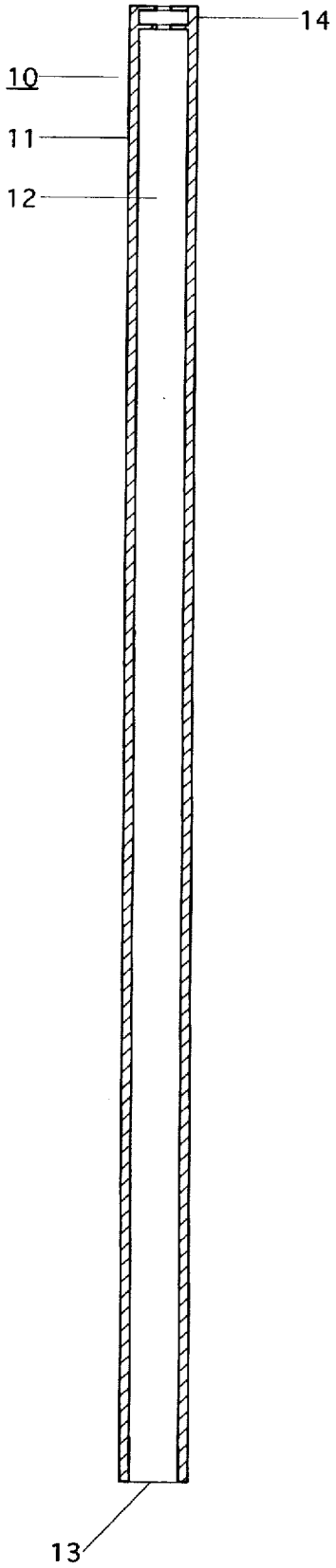
FIG. 1 shows a cross-sectional view of the musical device of this invention.
Figure 2:
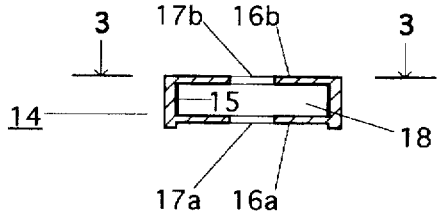
FIG. 2 is a cross-sectional detail of the hole tone resonator
Figure 3:
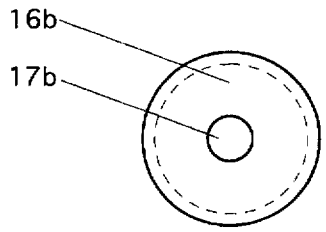
FIG. 3 is an end view of the musical device.

The musical device or wand 10 of this invention, shown in FIG. 1, is comprised of an exterior structure 11 enclosing a longitudinal resonator 12 with an open end 13, and a hole tone resonator 14, which is situated at one end of and substantially in alignment with longitudinal resonator 12. Referring to FIG. 2, hole tone resonator 14 consists of resonating chamber 18 enclosed by chamber wall 15 and two restrictive structures or disks **16*a* and 16*b*. At the center of restrictive disks 16*a* and 16*b* are apertures 17*a* and 17*b***.

Longitudinal resonator 12, enclosed by tube 11, is shown to be substantially longer than its diameter. Although this relative length is intended to be variable according to individual application, a length-to-diameter ratio of at least 20:1 is regarded as necessary for what the applicant regards as the invention.

The diameter of resonating chamber 18 and longitudinal resonator 12 are substantially equal.

The diameters of apertures **17*a* and 17*b* are substantially equal. This dimension is intended to be variable within the range of up to 50% of the diameter of resonating chamber 18**.

The distance between disks **16*a* and 16*b*—the height of resonating chamber 18—is intended to be variable within the range of approximately 50% greater or smaller than the diameter of aperture 17*a* or 17*b***.

It is shown that constituent members of wand 10 are formed as a single unit. It is considered within the scope of this invention that longitudinal resonator 12 and all or part of hole tone resonator 14 may be formed separately and attached by any means desired. Such means include, but are not limited to: threads, adhesives, slip surfaces, and compression surfaces.

Embodiments shown in FIGS. 5, 6, and 7 will be discussed in the next section.

OPERATION OF INVENTION

Only minimal airflow is necessary to cause the wand to sound musical tones. There are at least four ways to accomplish this:

1) Establish a pressure differential between the two ends. This is easily done by simply grasping the wand at either end and gently waving or swinging it.

2) Move it through the air along its longitudinal axis.

3) Cause an airstream to be directed through the wand.

4) Blowing

Blowing is not considered to be a viable option in the present invention, as blowing directly into the wand does not produce good musical results. Sounds emitted range from various shrieks to extremely muffled harmonics to no sound at all. Any one of these particular results depends on the blowing pressure, and on the dimensions of longitudinal resonator 12 and hole tone resonator 14.

Figure 4A:
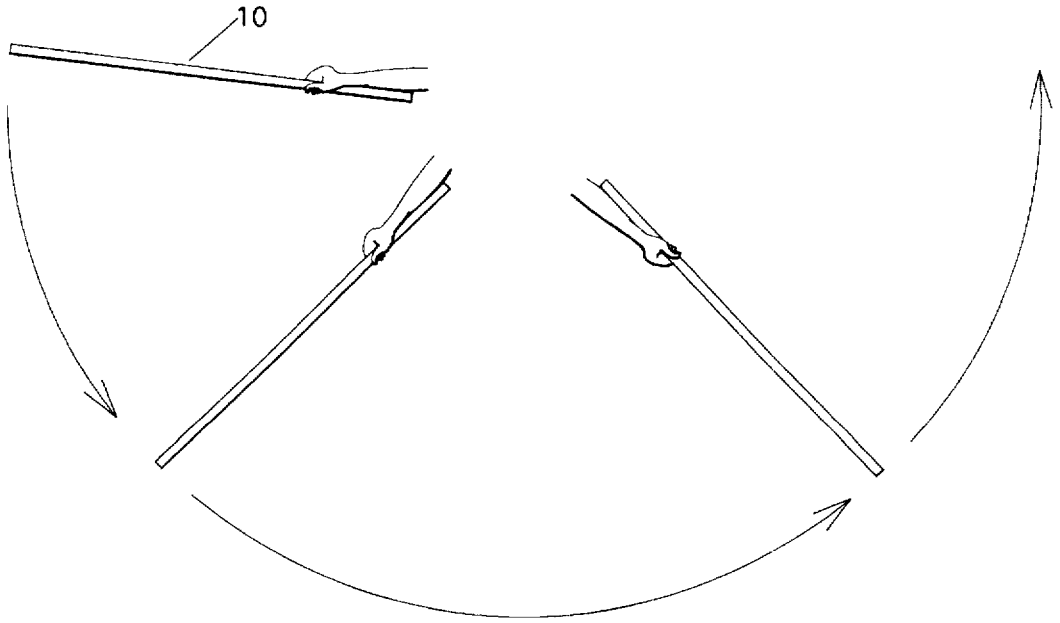
FIG. 4*a* shows a schematic view illustrating a swing of the musical device of this invention.
Figure 4B:
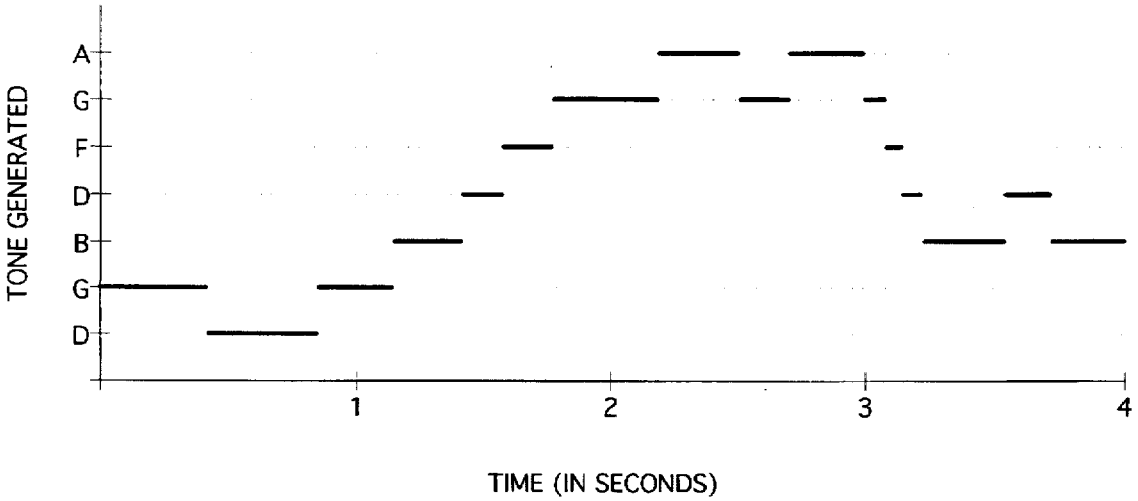
FIG. 4*b* is a chart illustrating frequency response associated with a swing of the musical device.

The first embodiment of the wand 10 is shown in FIG. 4*a* being grasped at one end and swung in an arc. It sounds equally well swung from either end. FIG. 4*b* shows an example of the audible response of a particular wand being swung through a range of speeds.

As wand 10 is swung, a small increase in speed causes the tone to jump to the next higher harmonic, while a decrease in speed causes it to jump to the next lower harmonic. Tone quality and responsiveness are determined by the dimensions of resonating chamber 18, the thicknesses of restrictive disks **16*a* and 16*b*, and the sizes of apertures 17*a* and 17*b*** (FIG. 2). The parameters of these dimensions are intended to be variable in order to optimize tone quality for individual applications.

The function of hole tone resonator 14 is to generate sound in response to minimal airflow therethrough. It does this by restricting airflow in such a way as to induce an oscillation in resonating chamber 18. Exceeding certain dimensional limits, however, renders this function inoperable. As stated, the diameters of apertures **17*a* and 17*b* (FIG. 2) are substantially equal, and intended to be variable within the range of up to 50% of the diameter of resonating chamber 18. The height of resonating chamber 18 is intended to be variable within the range of approximately 50% greater or smaller than the diameter of aperture 17*a* or 17*b***.

Applicant's experiments with various sizes of hole tone resonators show that optimum tone quality for smaller diameter wands (under 1½") is achieved with aperture diameters in the range of 20% to 30% chamber 18 diameter. Larger diameter wands (over 2") reach optimum tone quality with slightly relatively larger apertures. Tone quality is generally quite feeble when apertures **17*a* and 17*b* exceed 50% chamber 18** diameter. At 60% the tone has disappeared. Within these limits, up to a point, increasing either the apertures' diameter or chamber height generally increases the volume of the mid and lower tones; while decreasing either dimension gives clarity to mid and upper tones. Beyond these limits, the structure fails to function as a hole tone resonator.

Disks **16*a* and 16*b* may be extremely thin but must be quite stiff in order to efficiently produce sound. Each disk thickness is preferred to be less than 40% of the height of resonating chamber 18**.

A variation in any parameter of hole tone resonator 14 has an audible effect on the overall responsiveness and tone quality of wand 10.

The length and diameter of longitudinal resonator 12 determines which specific harmonic tones are available to the performer. Wands whose functional lengths are equal produce harmonic tones in the same key, but a small diameter wand sounds a greater number of higher harmonics while a larger diameter wand sounds fewer and lower harmonics.

The applicant's experiments with wands whose interior diameters range from ½" to 4" show that a length-to-diameter ratio of less than 5:1 requires very rapid swinging motion to produce only the fundamental pitch. U.S. Pat. No. 337,372 to Metcalf is an example of this configuration. A 10:1 relationship produces a more easily sounded strong fundamental tone. A wand with a ratio of 13:1 sounds the fundamental and, when swung faster, the first harmonic. Similarly, a musically useful wand able to sound three or more harmonic overtones requires longitudinal resonator 12 to have a minimum length-to-diameter ratio of approximately 20:1. As the relative length increases, so does the number of playable harmonic tones. Another reason favoring longer wands has to do with the relationship between speed of swing and tone production.

The optimum tone quality for any pitch is achieved at one particular airflow speed. This means that for short wands capable of producing only a single pitch, that pitch is optimum at only one very rapid swinging or whirling speed. Decreasing this speed causes the pitch to weaken, drop slightly, and then fade completely. For slightly longer wands, increasing the speed causes the pitch to fade and become noisy. But at a speed of twice that for the original pitch, the next harmonic sounds clearly. For wands above the L/d ratio of 20:1, the noisy intermittent areas between pitches are no longer in evidence. And above 32:1, the harmonic tones leap agilely from one to another without fading, bending, or distortion.

A specific wand with longitudinal resonator 12 length of 35" and diameter of ¾" sounds seven distinct and separate pitches when swung in an arcuate path at various speeds. These pitches are those of the third through the ninth harmonic modes of this particular resonator. In this example, an aperture 17*a* and 17*b* diameter of 3/16" sounds mid and upper tones more clearly, while a diameter of 7/32" increases the volume of mid and lower tones. Slightly varying the motion of wand 10 causes an immediate audible response, and it is this sensitivity that creates many melodic and rhythmic possibilities.

The performer may swing the wand in a back-and-forth motion to sound rhythmic arpeggiated patterns, or in loops, figure-eights, or circles to produce melodic phrases. Gently shaking the wand along its longitudinal axis causes it to generate rhythmic patterns which are easily varied by adjusting the style and intensity of the shaking motion.

In short, any movement or combination of movements generates its own particular musical sound pattern. This pattern may be repeated, or embellished upon by slightly varying the motion of the wand.

The performer may play more than one wand at a time. For example, a wand sounding lower harmonics may be used to provide a simple rhythmic accompaniment to a melodic wand played with the other hand.

Two or more wands may also be fastened together (such as side-to-side) to produce an instrument which sounds a variety of chords when set into motion.

Figure 5:
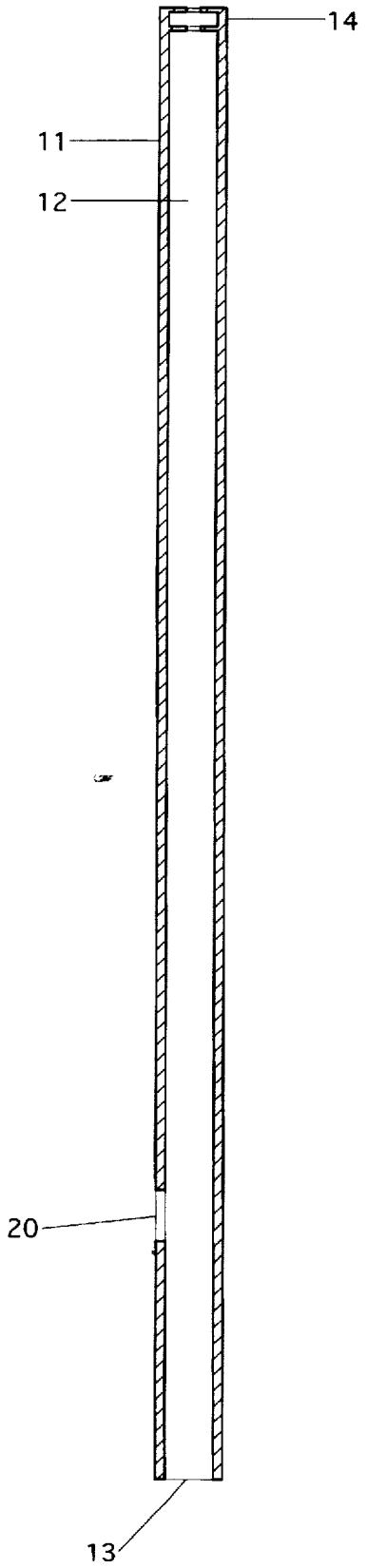
FIG. 5 shows a cross-sectional view of a musical device of the invention which is similar except for the addition of a tone hole.

FIG. 5 shows the addition of a tone hole 20 that provides the capability of changing the key in which the wand sounds. With tone hole 20 open, the functional length of longitudinal resonator 12 is shortened, causing all of its resonant modes to be higher in pitch. Alternately opening and closing tone hole 20 with thumb or fingertip during the course of a swing doubles the number of harmonic tones available to the performer. As the exact placement of tone hole 20 affects the pitch of the alternate key, wands of this embodiment can be made to sound the tones of different musical scales. (For example, tone hole 20 may be placed so as to enable the performer to play in a 'blues' mode.) This feature further enhances the wand's melodic and expressive capabilities.

In the previous example of the 35" wand, a tone hole was located 4¾" from the open end. Playing the wand with the tone hole open results in six new harmonic pitches. Alternately opening and closing the tone hole while varying the wand's motion results in access to thirteen musical tones in a diatonic scale (white keys) with a minor 7th.

It is desirable that the size of tone hole 20 be such that the resulting harmonics are in tune. A hole that is too small will result in a 'stretched' series of harmonics in which the lower tones are progressively flat. A tone hole 20 diameter of approximately 75% to 90% of longitudinal resonator diameter is preferred.

Figure 6:
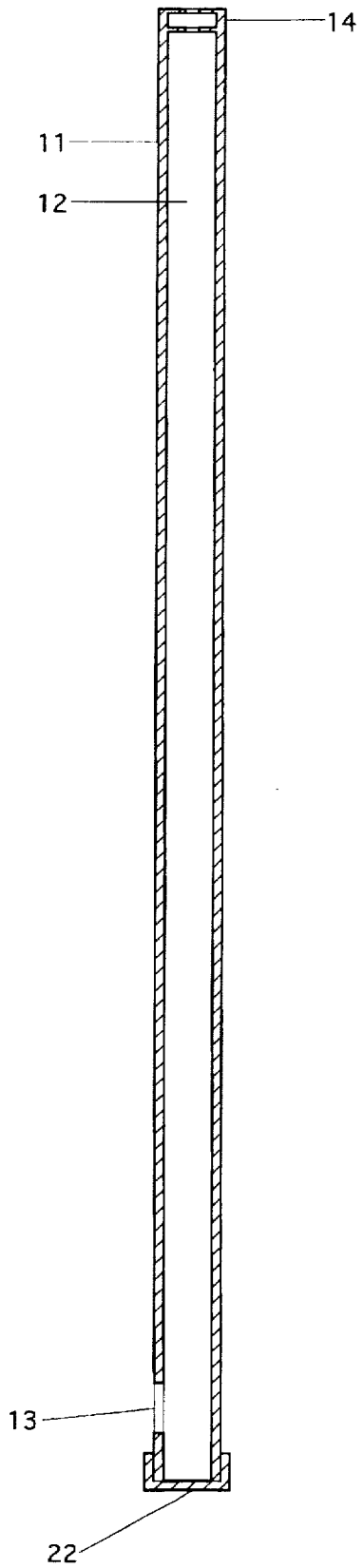
FIG. 6 illustrates an alternative placement of the open end of the musical device of the invention.
Figure 7:
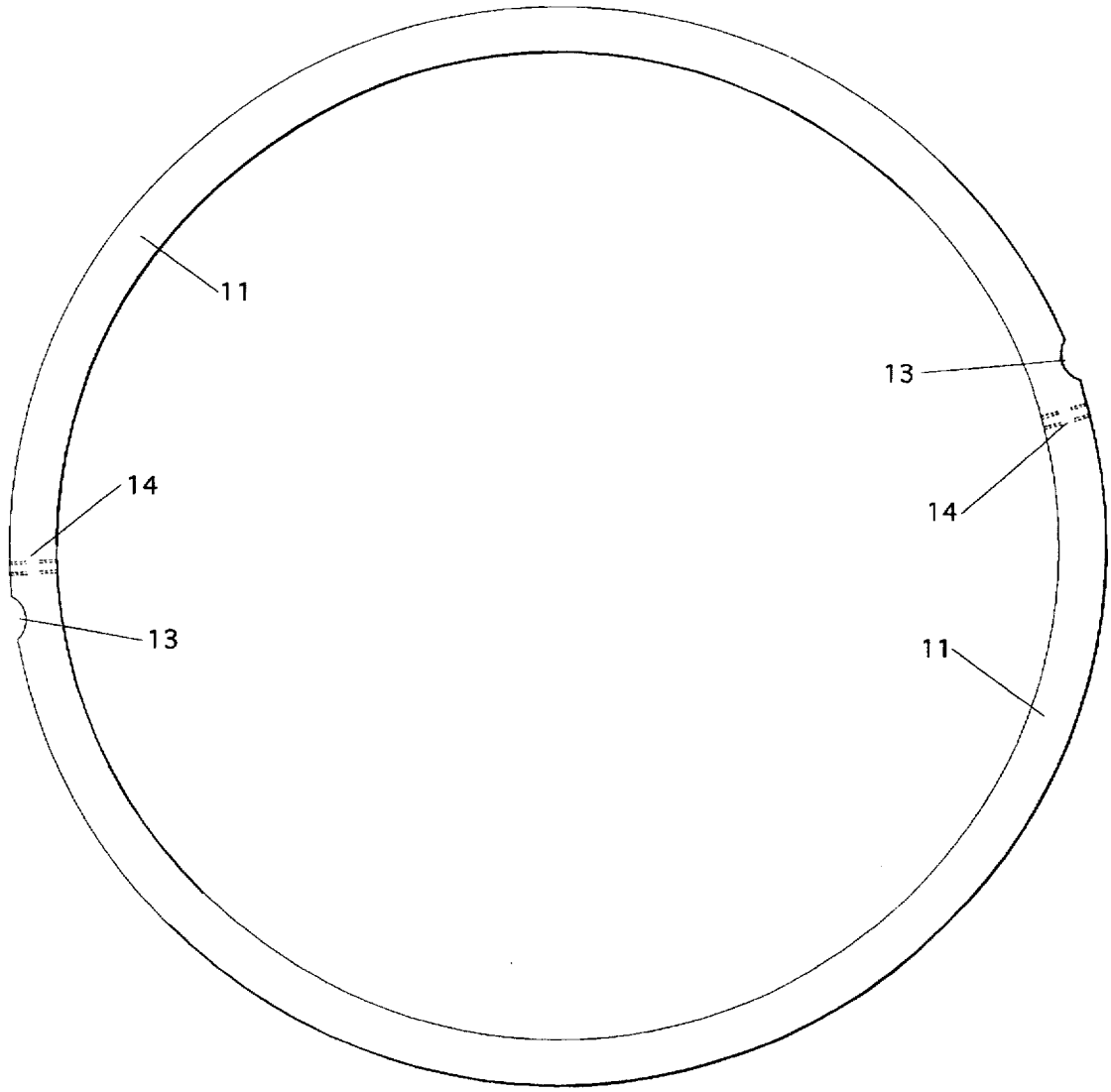
FIG. 7 shows an embodiment of the musical device of the invention in the form of a hoop consisting of a plurality of individual musical devices.

The third embodiment, illustrated in FIG. 6, shows open end 13 of longitudinal resonator 12 situated in the wall of exterior structure 11. An end cap 22 closes off the former open end. This placement of open end 13 causes the wand to be directional in its response. Grasping the wand near hole tone resonator 14 and swinging it away from open end 13 produces a response identical to that of wand 10 of the first embodiment. Twirling it in the manner of a baton also causes it to sound. Swinging it toward open end 13, however, causes no audible response. As a result of this directional response, other types of instruments become possible.

Two or more wands of this embodiment joined side-to-side with open ends 13 facing outwards creates an instrument whose tones change not only with the speed of the swing, but also with the direction. By using wands tuned to specifically related keys, the performer is able to sound different melodies and chords simply by varying the wands' speed and direction of motion.

In the fourth embodiment (FIG. 7), two or more wands are curved and joined end-to-end to form a hoop. Open ends 13 are situated in the wall of exterior structure 11, but an end cap is not used. In this embodiment, hole tone resonator 14 of one wand also functions as an end cap for the adjacent wand. The performer swings the hoop back and forth, holding it so as not to obstruct any open end 13. Because of the distribution of its weight, the hoop has a naturally even rate of swing. This gives the melody produced an inherent rhythmic quality. The orientation of the curved wands causes them to sound alternately as the hoop is swung, with the second wand beginning to sound as the first is finishing.

As with the single wands, it is the lengths of the individual component wands that determine the tones produced. For instance, a particular hoop consisting of two wands whose lengths are in the ratio of 4:3 is capable of producing all the pitches of a diatonic scale.

Other configurations of the wand are also possible. For example, hole tone resonator 14, like open end 13, may be located in the wall of external structure 11.

THEORY OF OPERATION

Until now, the hole tone resonator has been used for little else but acoustic experiments and whistling noisemakers. In all of these cases, the more extensive musical potential of this device has been overlooked. This may be due in part to its extraordinary sensitivity.

It is believed that the hole tone resonator functions in the wand as a pressure-sensitive oscillator. Just as a recorder fipple produces lateral oscillations in the airstream from the player's lips, the hole tone resonator produces longitudinal oscillations in the airflow through the wand. Both types of oscillations are dominated by fluctuating pressure differences in the column of air in the longitudinal resonator.

As the wand is grasped near open end 13 and swung, a low pressure area forms at the moving end. This causes air to be drawn through aperture 17*b* of hole tone resonator 14. At the same time, because the airflow is restricted, pressure builds up at restrictive disk 16*a*. The pressure difference causes air to flow through aperture 17*a* whereupon the pressure wave in longitudinal resonator 12 is reflected back toward the open end, initiating the formation of a standing wave. Meanwhile, the jet from aperture 17*a* into resonating chamber 18, being highly pressure-sensitive, begins to oscillate at the same frequency as the standing wave in longitudinal resonator 12. This resonance-controlled feedback forms an oscillator circuit that reinforces the standing wave. As the wand is swung faster, the airflow increases and the standing wave is caused to vibrate at progressively higher frequencies which correspond to harmonic modes of the longitudinal resonator. These vibrations, in turn, are also reinforced through this process of resonance-controlled feedback.

The process is the same when the wand is swung from the other end, only the direction of airflow is reversed.

To summarize: when air is forced through the hole tone resonator alone, the pitch frequency rises with air velocity and quickly becomes quite shrill. Coupling it with a longitudinal resonator creates the potential for the tones to form a harmonic relationship, but forced air still yields shrill tones. However, when airflow is caused by the creation of a small pressure differential, the resulting vibration is determined not by air pressure, but rather by the harmonic modes of the longitudinal resonator.

CONCLUSIONS

The results achieved by my invention are believed to be superior to other instruments activated by motion. The prior art consists primarily of devices which are noisemakers, being incapable of producing clear musical sounds. Those that can produce musical tones have a very limited range, and are sluggish in their response to changes in motion. In addition, either their tone quality is vastly inferior or they require rapid whirling speeds that make them unwieldy and difficult to control, thus posing a hazard. Rayleigh's experimental device used an open-sided "bird call" which rendered it greatly inferior as a motion-activated musical instrument. Moreover, the actual use of it as a motion-activated instrument was not suggested.

It is believed that the musical device of my invention constitutes a novel juxtaposition of a longitudinal resonator with a hole tone resonator. It is further believed that the results it achieves as a motion-activated musical instrument are unique and unexpected.

The invention is accordingly presented as a musical device which is easily played by musician and non-musician alike.

It will be appreciated by those skilled in the art that the musical device of my invention provides a new musical experience for persons of all ages and abilities. It features numerous advantages:

- It sounds pleasant musical tones in response to minimal motion.
- It can be made in different sizes, shapes, and configurations to suit specific applications.
- It responds audibly not only to swinging motions but also to tossing, twirling, shaking, and throwing motions as well.
- Its inherent ability to sound musical tones in response to a wide variety of movements makes it ideally suited for incorporation into the design of products such as toy swords, batons, hoops, and baseball bats.
- The device may be made from virtually any rigid, semi-rigid, or even flexible material, singly or in combination. Such materials include, but are not limited to: cardboard; metals, such as aluminum, brass, copper, and stainless steel; and plastics, such as polyethylene, polypropylene, polyurethane, and vinyl.
- Its dimensions may be varied substantially to provide devices which play in higher and lower registers, different keys, and combinations of keys.
- Because the device sounds predetermined harmonically related tones, any number of devices in the same key or keys may be played together by a group, with no possibility of anyone hitting a "wrong" note.
- No musical ability is required of the performer, yet the response of the device encourages development of rhythmic and melodic sensitivity.

Although the above description contains many specifics, these should not be construed as limiting the scope of the invention but as merely providing illustrations of some of the presently preferred embodiments of this invention. For example: different sizes and configurations of the wand are considered to be within the scope of this invention; the orientation and location of the hole tone resonator relative to the longitudinal resonator are considered to be variable. The dimensions of the hole tone resonator chamber, restrictive disks, and apertures are all considered to be variable; the longitudinal resonator may take other shapes including, but not limited to, conical or cylindri-conical and may be of variable length and diameter and/or possess a sliding extension for tuning purposes; the exterior structure of the wand may be of variable thickness or texture to facilitate grasping with the hand.

Individual wands or wand assemblies appropriately positioned within air currents would automatically sound as air moved through them. Such devices are considered to be within the scope of this invention.

I claim:

1. A hand-held musical device for producing several discrete musical tones in response to minimal motion comprising: a wand having first and second ends wherein the wand includes (a) a longitudinal resonator comprising an elongated cavity having a solid inner wall for receiving and transmitting airflow therethrough, said wand being open at said first end, said cavity possessing a predetermined length and diameter capable of supporting longitudinal sound waves associated with harmonics of said longitudinal resonator, said length being at least twenty times said diameter, and (b) a hole tone resonator disposed substantially at said second end of said wand, said hole tone resonator comprising a chamber enclosed by a chamber wall and two restrictive circular apertures, said chamber possessing a predetermined diameter substantially equal to diameter of said longitudinal resonator, both said apertures capable of transmitting airflow therethrough, said apertures being of substantially equal diameters and being coaxial with said chamber, each said aperture diameter being no more than fifty percent of said chamber diameter, and c) a tone hole disposed in said inner wall intermediate and between said first and second ends, said tone hole being more proximate to said first end, and being distinct and separate from said first end, whereby a performer may quickly effect complete opening and closure of said tone hole with a thumb or finger while simultaneously grasping and swinging said wand, thereby creating melodic phrases from two distinct sets of harmonic overtones.

2. A musical device for producing several discrete musical tones in response to minimal motion comprising: a plurality of wands each having first and second ends wherein the wands each include (a) a longitudinal resonator comprising an elongated cavity having a solid inner wall for receiving and transmitting airflow therethrough, said wand being open at said first end, said cavity possessing a predetermined length and diameter capable of supporting longitudinal sound waves associated with harmonics of said longitudinal resonator, said length being at least twenty times said diameter, and (b) a hole tone resonator disposed substantially at said second end of said wand, said hole tone resonator comprising a chamber enclosed by a chamber wall and two restrictive circular apertures, said chamber possessing a predetermined diameter substantially equal to diameter of said longitudinal resonator, both said apertures capable of transmitting airflow therethrough, said apertures being of substantially equal diameters and being coaxial with said chamber, each said aperture diameter being no more than fifty percent of said chamber diameter, wherein said wands are attached end to end and possess curvature, forming a closed hoop, said open first end of each of said wands being disposed about said inner wall of each wand substantially near hole tone resonator of each adjacent wand.

3. The musical device of claim 2 with the addition of a tone hole in at least one of said wands, said tone hole being disposed in said inner wall intermediate and between first and second ends, being more proximate to first said end.

* * * * *